US009784060B2

(12) United States Patent
Hiorth et al.

(10) Patent No.: US 9,784,060 B2
(45) Date of Patent: Oct. 10, 2017

(54) JUNK CATCHING DEVICE

(71) Applicant: Interwell Technology AS, Ranheim (NO)

(72) Inventors: Espen Hiorth, Trondheim (NO); Christian Malvik, Heimdal (NO)

(73) Assignee: Interwell Technology AS, Ranheim (NO)

( * ) Notice: Subject to any disclaimer, the term of this patent is extended or adjusted under 35 U.S.C. 154(b) by 195 days.

(21) Appl. No.: 14/440,598

(22) PCT Filed: Oct. 29, 2013

(86) PCT No.: PCT/EP2013/072578

§ 371 (c)(1),
(2) Date: May 5, 2015

(87) PCT Pub. No.: WO2014/079661

PCT Pub. Date: May 30, 2014

(65) Prior Publication Data

US 2015/0300118 A1 Oct. 22, 2015

(30) Foreign Application Priority Data

Nov. 20, 2012 (NO) ..... 20121377

(51) Int. Cl.
*E21B 27/00* (2006.01)
*E21B 31/00* (2006.01)
*E21B 23/01* (2006.01)

(52) U.S. Cl.
CPC ..... *E21B 27/00* (2013.01); *E21B 23/01* (2013.01); *E21B 31/00* (2013.01)

(58) Field of Classification Search
CPC ..... E21B 27/00; E21B 23/01; E21B 31/00
See application file for complete search history.

(56) References Cited

U.S. PATENT DOCUMENTS 2,300,438 A 11/1942 Spang
2,927,644 A * 3/1960 Caldwell ..... E21B 27/00 166/117
3,107,742 A 10/1963 Woods
3,227,216 A * 1/1966 Bumpers ..... E21B 27/00 166/66.5

(Continued)

FOREIGN PATENT DOCUMENTS

GB 2170837 * 2/1985 ..... E21B 31/08
GB 2170837 8/1986

*Primary Examiner* — Yong-Suk (Philip) Ro
(74) *Attorney, Agent, or Firm* — Christian D. Abel

(57) ABSTRACT

A junk catching device (1) for catching junk traveling into a well. The device comprises an outer housing (10) comprising an upper end (10*a*) and a lower end (10*b*), a bore (11) provided inside the housing (10), a receiving device (20) provided in the upper end (10*a*) of the housing (10). The receiving device (20) comprises a receiving opening (21) providing an opening into the bore (11) and a junk guiding device (22) for guiding junk into the bore (11) via the receiving opening (21). The junk guiding device (22) is configured to be provided in a run state, in which the outer diameter of a guiding section (22A) of the junk guiding device (22) is less than or equal to the outer diameter of the housing (10), and in a set state, in which the outer diameter of the guiding section (22A) of the junk guiding device (22) is larger than the outer diameter of the housing (10).

10 Claims, 4 Drawing Sheets

(56) References Cited

U.S. PATENT DOCUMENTS

| | | | | | |
|---|---|---|---|---|---|
| 3,378,089 | A * | 4/1968 | Marsh | E21B 27/00 | 166/66.5 |
| 4,059,155 | A * | 11/1977 | Greer | E21B 21/103 | 166/301 |
| 4,111,262 | A * | 9/1978 | Duncan | E21B 27/00 | 166/162 |
| 4,276,931 | A * | 7/1981 | Murray | E21B 21/103 | 166/169 |
| 4,390,064 | A * | 6/1983 | Enen, Jr. | E21B 27/00 | 166/162 |
| 4,828,026 | A * | 5/1989 | Nelson | E21B 31/06 | 166/99 |
| 7,753,113 | B1 * | 7/2010 | Penisson | E21B 27/00 | 166/162 |
| 2009/0200030 | A1 | 8/2009 | Mills | | |

* cited by examiner

JUNK CATCHING DEVICE

CROSS-REFERENCE TO RELATED APPLICATIONS

This application is a National Stage application under 35 U.S.C. §371 of international application PCT/EP2013/072578 filed 29 Oct. 2013.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

Field of the Invention

The present invention relates to a junk catching device.

Description of the Related Art Including Information Disclosed 37 CFR 1.97 and 1.98

During some types of working operations in the well, there is a risk that junk, such as debris, metal fragments, metal parts or other unwanted objects will travel (i.e. fall or sink) down into the well. A junk catching device is a tool used in oil and/or gas wells for catching such junk and thereby preventing it from traveling further down into the well.

The unwanted objects are often also referred to as "fish", as such objects must be fished or picked up from the well before other types of operations can be performed. If not, these objects may present obstructions which may prevent well tools from passing their location in the well.

A junk catching device may also be provided above plugging devices, such as bridge plugs, straddle packers etc in order to prevent drilling fluid to enter the annular space between the plugging devices and the inner surface of the well pipe. Such well fluid tend to precipitate solid matter over time, and if the solid matter reaches anchoring devices or supporting devices for sealing elements of plugging devices, then such plugging devices may be difficult to retrieve from the well. Such situations may occur of it is necessary to interrupt an offshore oil/gas well due to bad weather conditions, where it may take several weeks to continue the well operation.

U.S. Pat. No. 3,107,742 describes an apparatus for recovery of drill cuttings from subsurface earth formations. It comprises a guiding device for guiding junk into a junk container. The guiding device is made of a plurality of elongated spring wires.

GB 2170837 A describes a junk sub comprising a membrane extending from a lip into the annulus. A movable cover may be used to protect the membrane during drilling or circulation.

U.S. Pat. No. 2,927,644 A describes a junk basket with a rubber cup for guiding junk into the junk basket.

U.S. Pat. No. 2,300,438 discloses a retrievable well packer comprising a neoprene cup 39 to catch sediments from falling into the well.

The objects of the invention is to provide a junk catching device which can be set in a well, which is able to prevent junk from passing the device (i.e. it has a high catch rate) and which can be retrieved from the well after use.

BRIEF SUMMARY OF THE INVENTION

The present invention relates to a junk catching device for catching junk traveling into a well, comprising:

- an outer housing comprising an upper end and a lower end;
- a bore provided inside the housing;
- a receiving device provided in the upper end of the housing, where the receiving device comprises:
  - a receiving opening providing an opening into the bore;
  - a junk guiding device for guiding junk into the bore via the receiving opening, where the junk guiding device is configured to be provided in a run state, in which the outer diameter of a guiding section of the junk guiding device is less than or equal to the outer diameter of the housing, and in a set state, in which the outer diameter of the guiding section of the junk guiding device is larger than the outer diameter of the housing.

In one aspect, is the junk guiding device is funnel-shaped in the set state.

In one aspect, the junk guiding device is funnel-shaped when unaffected by external forces.

In one aspect, the junk guiding device is compressed to a cylindrical shape in the run state.

In one aspect, the junk guiding device comprises a bending area aligned with an upper end rim of the housing in the set state.

In one aspect, the receiving device comprises a sleeve device fixed to an attachment section of the junk guiding device, where the sleeve device is axially displaceable within the bore of the housing.

In one aspect, the sleeve device is fixed to the outer housing by means of a shear pin in the run state and/or the set state.

In one aspect, the junk guiding device is further configured to be provided in a pull state, in which the junk guiding device is pushed into the bore of the housing.

In one aspect, the sleeve device comprises an upper end rim.

In one aspect, the junk catching device further comprising a slips device for anchoring to the well, where the slips device is configured to be provided between a run state and a set state.

BRIEF DESCRIPTION OF THE SEVERAL VIEWS OF THE DRAWINGS

Embodiments of the invention will now be described in detail with reference to the enclosed drawings, where.

DETAILED DESCRIPTION OF THE INVENTION

Figure 1:
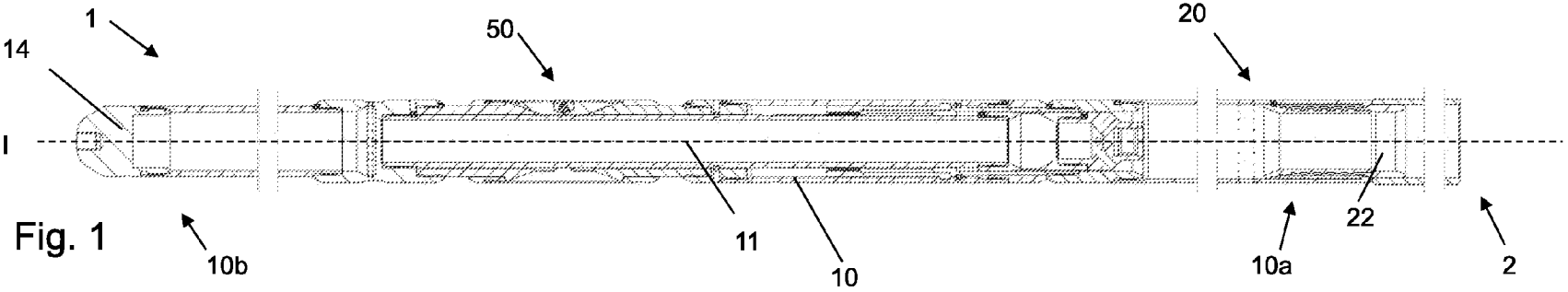
FIG. 1 illustrates a first embodiment of a junk catching device in a run state.
Figure 2:
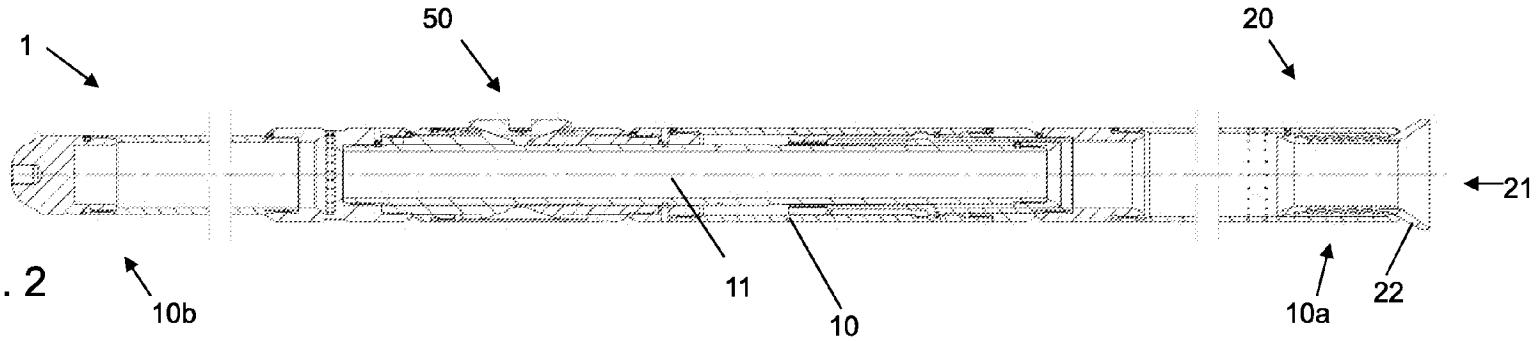
FIG. 2 illustrates the first embodiment of the junk catching device in a set state.
Figure 3:
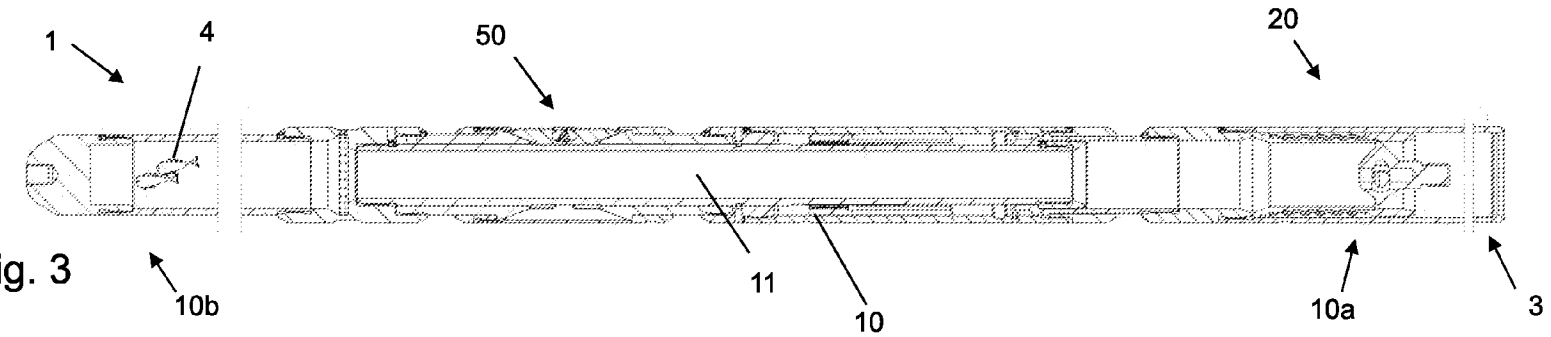
FIG. 3 illustrates the first embodiment of the junk catching device in a pull state.

It is now referred to FIGS. 1, 2 and 3. Here it is shown a junk catching device 1 for catching junk traveling into a well. The well is typically a oil and/or gas well. In FIG. 1, a setting tool is indicated by arrow 2. In FIG. 3, a pulling tool is indicated by arrow 3.

The junk catching device 1 comprises an outer housing 10 and is substantially cylindrical in its shape, in order to be inserted into the well. The longitudinal axis of the outer housing 10 is indicated with a dashed line I. The outer housing 10 comprises an upper end 10*a* and a lower end 10*b*. The lower end 10*b* is inserted into the well before the upper end 10*a*, i.e. if junk is traveling into the well, the junk will travel in the direction from the upper end to the lower end, i.e. from the right side of the drawings to the left side of the drawings.

A bore 11 is provided inside the housing 10. The purpose of the bore is to store the junk being caught by the junk catching device 1. As seen in the drawings, the lower end 10*b* of the housing is closed by a nose section 14. In FIG. 3, fish 4 is shown in the lower end of the bore 11, representing junk (often referred to as "fish" as described above).

The junk catching device further comprises a receiving device 20 provided in the upper end 10*a* of the housing 10. The receiving device 20 comprises a receiving opening 21 providing an opening into the bore 11 and a junk guiding device 22 for guiding junk into the bore 11 via the receiving opening 21.

Figure 7:
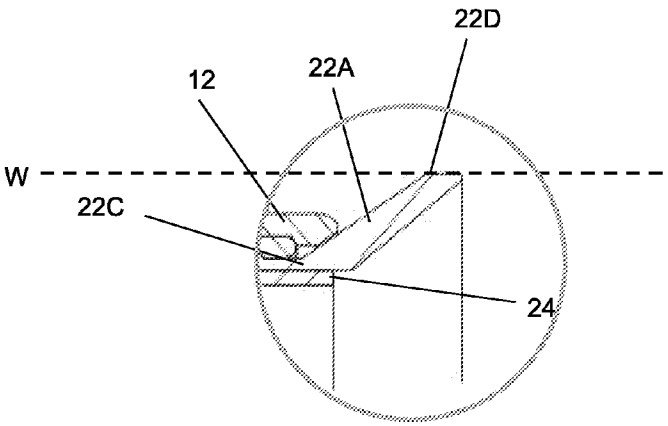
FIG. 7 illustrates a detail of FIGS. 2 and 5.

The outer diameter of the housing 10 is smaller than the inner diameter of the well, in order to be able to pass narrow passages in the well. The purpose of the receiving device 20 is to prevent junk from entering the space between the outer housing 10 and the inner surface of the well. The inner surface of the well is indicated in FIG. 7 by a dashed line W.

Figure 4:
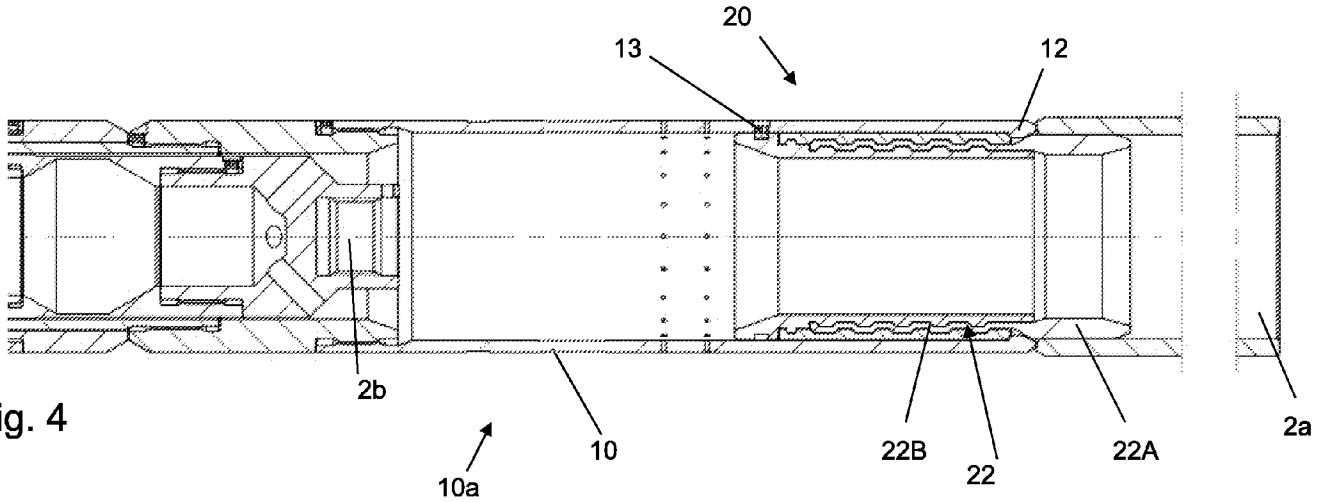
FIG. 4 illustrates an enlarged view of the upper part of FIG. 1.
Figure 5:
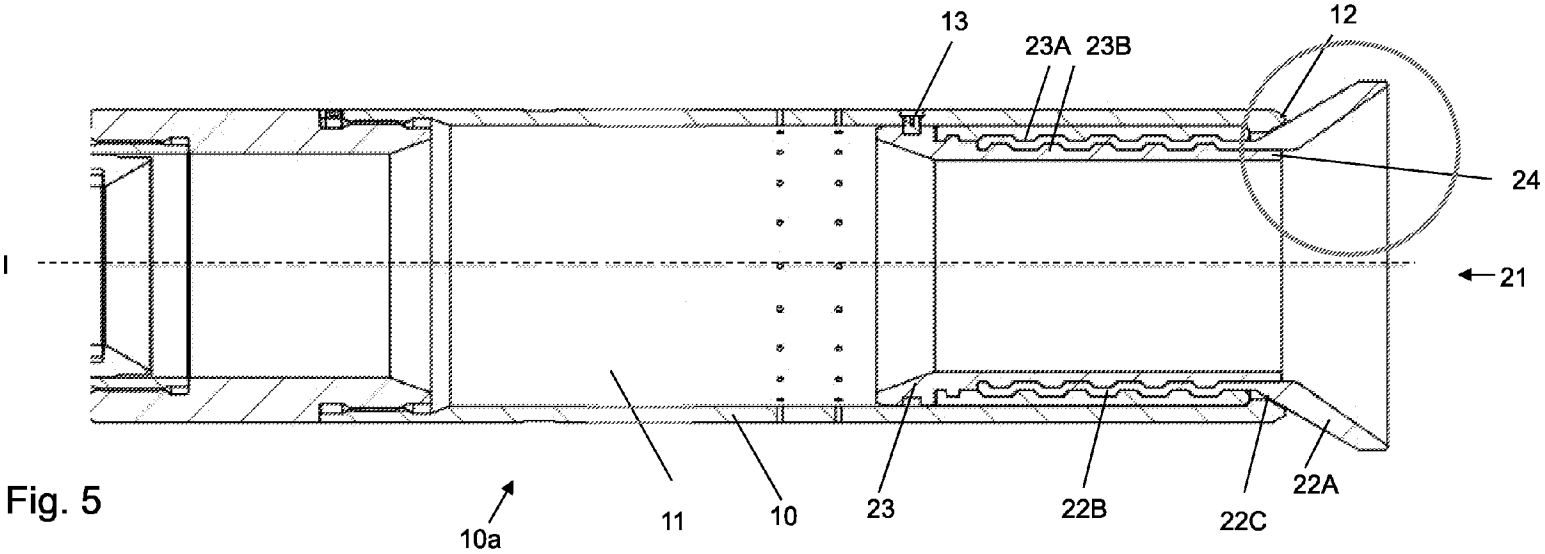
FIG. 5 illustrates an enlarged view of the upper part of FIG. 2.
Figure 6:
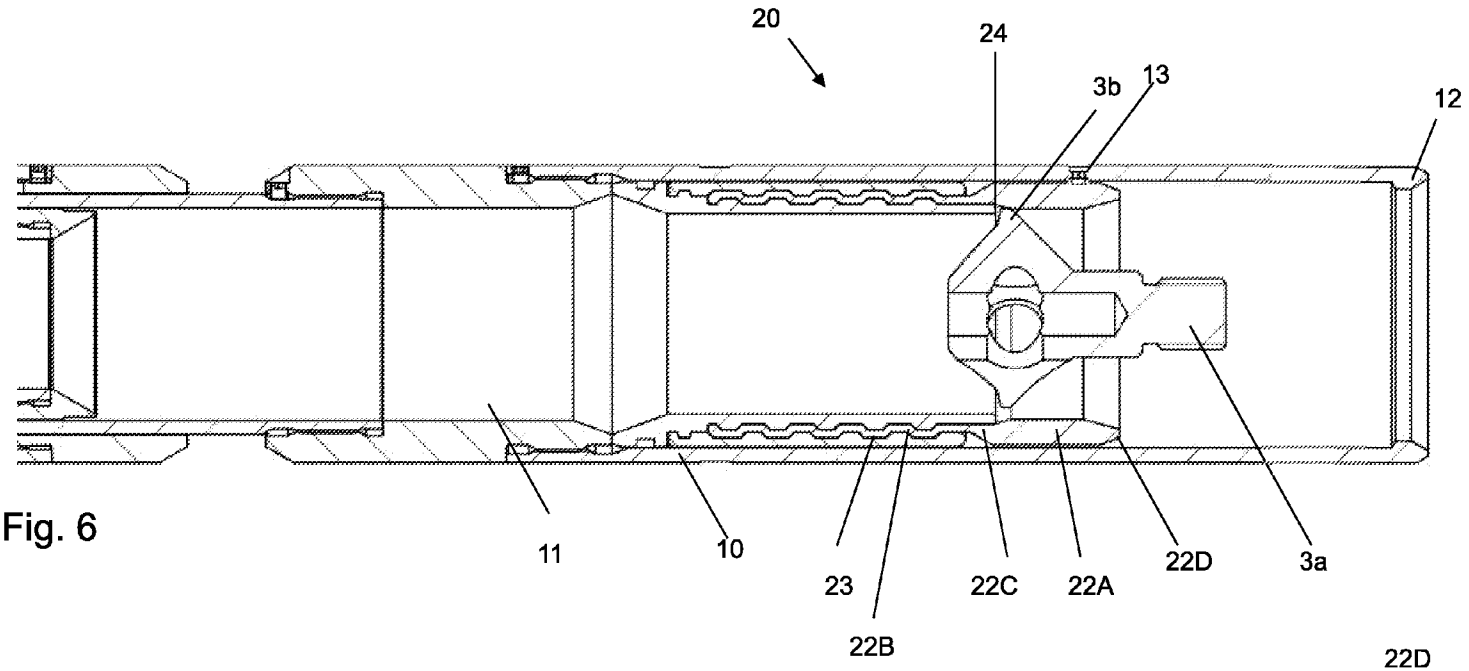
FIG. 6 illustrates an enlarged view of the upper part of FIG. 3.

Well tools generally have the following states:

- a run state, in which the outer diameter of the tool is smaller than the inner diameter of the well in order for the tool to be inserted into the well (i.e. to "run" the tool)
- a set state, in which anchoring devices, sealing devices etc are radially expanded in order to fasten the tool to the inner surface of the well (i.e. to "set" the tool)
- a pull state, in which the anchoring devices, sealing devices etc are radially retracted in order to pull the tool out of the well It is now referred to FIGS. 4, 5 and 6. Here it is shown that the junk guiding device 22 comprises a guiding section 22A and an attachment section 22B. A bending area 22C is defined between the guiding section 22A and the attachment section 22B. The junk guiding device 22 is in the present embodiment made of a semi-rigid material, such as short-aramid-fibre reinforced rubber material, carbon, aramid and/or textile fibre reinforced rubber material, plate spring material, thermosetting plastic or thermoplastic material, fibre fabric materials or similar materials.

The junk guiding device 22 may be molded in one process, resulting in one body comprising the guiding section and the attachment section. In the present embodiment the junk guiding device 22 is molded into a body being substantially funnel-shaped, i.e. substantially corresponding to the shape shown in FIG. 5. Here, the guiding section 22A forms an upper part of a funnel, which has a broad, substantially circular opening 21 narrowing down to a substantially cylindrical part formed by the attachment section 22B.

The flexibility of the material of the junk guiding device 22 makes it possible to compress the junk guiding device 22 into a substantially cylindrical shape, as shown in FIG. 4 and FIG. 6. Here, the guiding section 22A is compressed into a substantially cylindrical shape while the attachment section 22B maintains its original shape of a cylinder. However, when the junk guiding device 22 is unaffected by external forces, it will return to its initial funnel-shape.

Hence, the junk guiding device 22 may be provided in two different states. The junk guiding device 22 is configured to be provided in a run state, in which the outer diameter of the guiding section 22A of the junk guiding device 22 is less than or equal to the outer diameter of the housing 10, and in a set state, in which the outer diameter of the guiding section 22A of the junk guiding device 22 is larger than the outer diameter of the housing 10.

In FIG. 4, the run state is shown. Here, the guiding section 22A is provided radially inside a housing 2*a* of the setting tool 2, i.e. in the run state the junk guiding device 22 is compressed to a substantially cylindrical shape. As shown in FIG. 4, the diameter of the housing 2 is substantially equal to the diameter of the outer housing 10. In the set state, it is shown that the bending area 22C is aligned with an upper end rim 12 of the housing 10 in the set state.

In FIG. 4 the set state is shown. Here the setting tool 2 has been removed, including the housing 2*a*. The guiding section 22A of the junk guiding device 22 is here free to expand radially towards its initial shape. Hence, in the set state, the junk guiding device 22 is funnel-shaped. In FIG. 7 it is shown that an outermost area 22D of the junk guiding device 22 has expanded radially into contact with the inner surface W of the well. If there are no damages to the inner surface of the well, the junk guiding device 22 will seal against the entire circumference of the inner surface W of the well, and thereby guiding junk into the opening 21 in a very efficient way, i.e. no junk will be able to pass the area between the junk guiding device 22 and the inner surface of the well.

Preferably, the guiding section 22A is molded into a funnel-shaped body having a diameter slightly larger than the expected inner surface of the well in order to apply a pressure towards the inner surface to the well.

The receiving device 20 further comprises a sleeve device 23. The sleeve device 23 is fixed to the attachment section 22B of the junk guiding device 22. The sleeve device 23 comprises an outer sleeve section 23A and an inner sleeve section 23B, where the attachment section 22B is fixed radially between the outer sleeve section 23A and an inner sleeve section 23B. The sleeve device 23 is axially displaceable within the bore 11 of the outer housing 10. In FIGS. 4, 5 and 6 it is shown that the attachment section 22B is corrugated and fitted between corrugated surfaces of the outer sleeve section 23A and the inner sleeve section 23B.

In FIG. 5 it is shown that the sleeve device 23 comprises an upper end rim 24. More specific, it is the inner sleeve section 23B which is comprising the upper end rim 24.

In FIG. 6, it is shown that the junk guiding device 22 is configured to be provided in a pull state. In the pull state, the guiding device 22 is pushed into the bore 11 of the housing 10. Hence, the guiding section 22A is compressed into a substantially cylindrical shape and the entire guiding device 22 is substantially cylindrical again. In the pull state, it is easy to pull the device 1 out from the well.

The operation of the first embodiment as shown in FIG. 1-7 will now be described. First, it should be noted that in this embodiment, the device 1 comprises a slips device 50 for anchoring to the well, where the slips device 50 is configured to be provided between a run state and a set state. Consequently, the first embodiment of the device is an independent device which can be set independently of other tools in the well.

Initially, the device 1 is connected to the setting tool 2. As shown in FIG. 1, the slips device 50 is in the run state, i.e. the slips are radially retracted. Moreover, the junk guiding device 22 is provided inside the sleeve 2*a* of the setting tool. As shown in FIG. 4, the setting tool 2 also comprises an actuating device 2*b* for actuating the slips device 50. It should be noted that not all parts of the setting tool 2 is illustrated in FIGS. 1 and 4.

The device 1 is then run into the well to the desired location. The slips device 50 is then radially expanded to their set position by means of the setting tool 2. The slips device 50 and its activation by the setting tool 2 are considered known for a skilled person and will not be described here in detail. When the slips device 50 is set, the setting tool 2 is pulled out of the well. Hence, the junk guiding device 22 is not affected by the sleeve 2*a* and hence the guiding section 22A of the junk guiding device 22 is brought to its set state as described above and as shown in FIGS. 2 and 5.

Junk or "fish" 4 traveling into the well will now fall into the bore 11 via the opening 21. In some wells, there may be fluid flowing even when the junk catching device is to be set. Consequently, the device 1 may comprise screen openings 18, through which fluid may pass between the bore 11 and the well below the junk guiding device 22.

After use, the device 1 is pulled out of the well by means of the pulling tool 3. First, the pulling tool 3 is lowered into the well. The pulling tool 3 comprises an actuating tool 3*a* comprising a circular interface 3*b* configured to contact the upper end rim 24 of the sleeve device 23. Moreover, the pulling tool 3 comprises a fish neck device for connection to the upper end rim 12 of the outer housing 10.

Hence, by preventing downward movement of the outer housing 10 and pushing the actuating tool 3*a* downwards, the sleeve device 23 is pushed down into the outer housing 10. Consequently, also the junk guiding device 23 is pushed into the outer housing 10, bringing the junk guiding device 23 into its pull state.

It should be noted that the sleeve device 23 may be fixed to the outer housing 10 by means of a shear pin 13 in the run state and/or the set state. Hence, a force exceeding the shear force of the shear pin 13 must be applied by the pulling tool before the sleeve device 23 may be moved into the outer housing 10.

By pushing the actuating tool 3*a* further downwards, also the slips device 50 is radially retracted to a pull state, and the device 1 may be pulled out from the well.

Figure 8:
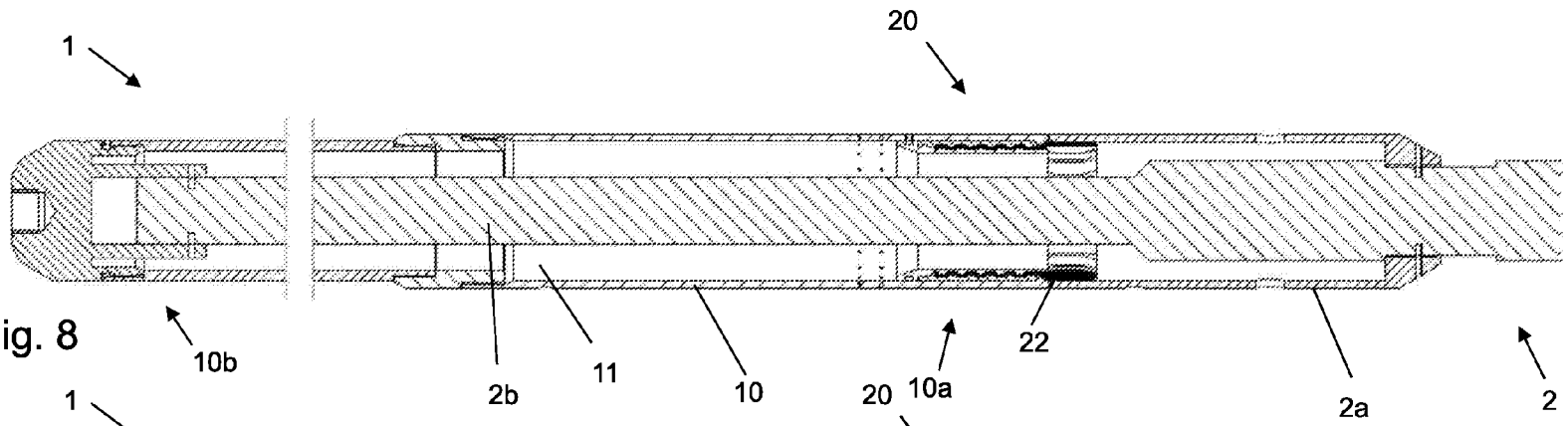
FIG. 8 illustrates a second embodiment of a junk catching device in a run state.
Figure 9:
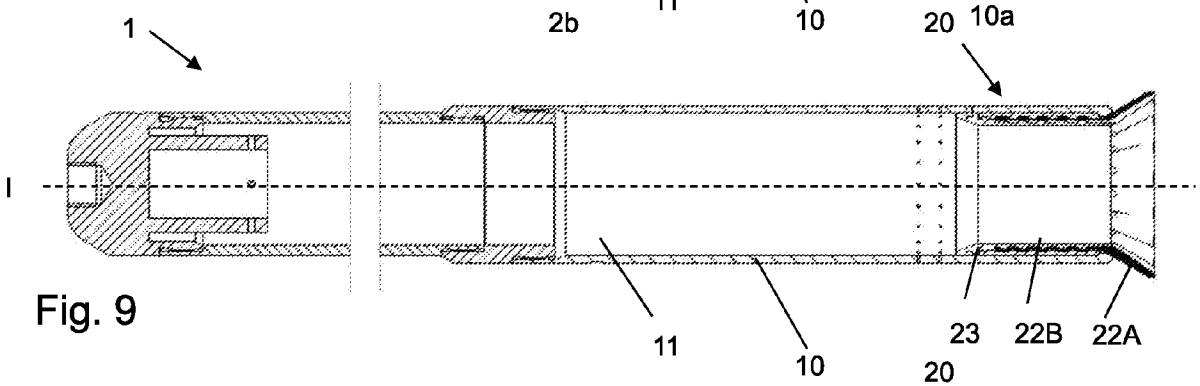
FIG. 9 illustrates the second embodiment of the junk catching device in a set state.
Figure 10:
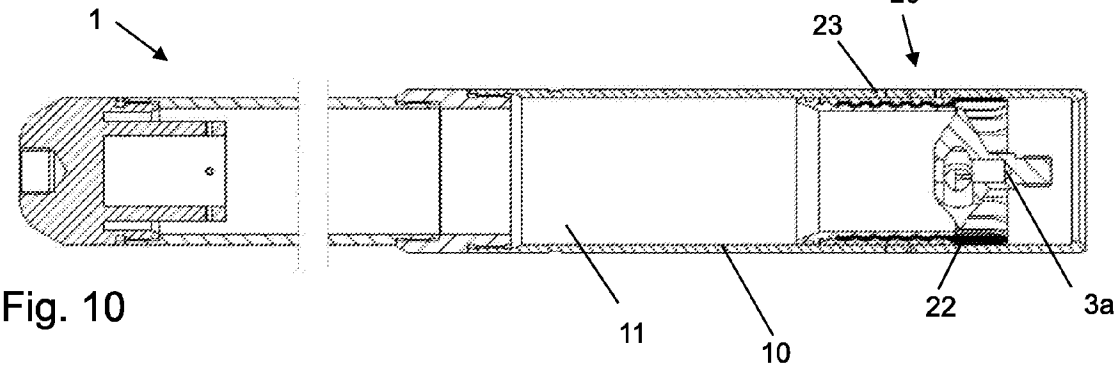
FIG. 10 illustrates the second embodiment of the junk catching device in a pull state.

It is now referred to FIGS. 8-10, illustrating a second embodiment of the invention. The second embodiment has many features in common with the first embodiment, and the same reference numbers are used for the same parts. The most important difference is that the second embodiment is not provided with the slips device 50.

The intended use of the second embodiment is to place it above other tools in a well as protection for junk which may travel into the well.

As in the first embodiment, the junk guiding device 22 is held in its run state within the housing 2*a* of the setting tool 2, and it expands radially to its set state when the setting tool is removed. The junk guiding device 22 is brought to its pull state by pushing the sleeve device 23 into the housing 10. Also here, the lower end 10*b* of the outer housing is closed by a nose section 14.

There are several other alternatives of the invention as well. First of all, the junk catching device 1 may be provided as a part of a well tool instead of as a separate tool. For example, the junk catching device 1 may be provided as a part of a well plug, for example a straddle tool, a packer tool, a plug etc.

If such a tool comprises a through bore (such as a packer tool), the nose section 14 may be omitted from the lower end of the housing 10. Hence, junk will be prevented from travelling to the radial space between the tool and the inner surface of the well, but the junk is allowed to travel into the bore 11 and further through the bore of the packer tool and further into the well.

In another alternative embodiment, the junk guiding device 22 may be provided inside the outer housing 10 in the run state instead of inside the setting tool 2*a*. In such an embodiment, the guiding section 22A of the junk guiding device 22 must be pulled upwardly past the upper end rim 12 in order to be allowed to be brought to its set state.

The invention claimed is:

1. Junk catching device for catching junk traveling into a well, comprising:

an outer housing comprising an upper end and a lower end;

a bore provided inside the housing;

a receiving device provided in the upper end of the housing, where the receiving device comprises:

a receiving opening providing an opening into the bore;

a junk guiding device for guiding junk into the bore via the receiving opening, where the junk guiding device is configured to be provided in a run state, in which the outer diameter of a guiding section of the junk guiding device is less than or equal to the outer diameter of the housing, and in a set state, in which the outer diameter of the guiding section of the junk guiding device is larger than the outer diameter of the housing;

wherein:

the guiding section is molded into a funnel-shaped body of which an outermost area is configured to be expanded radially into contact with the inner surface of the well in the set state;

the receiving device comprises a sleeve device fixed to an attachment section of the junk guiding device, where the sleeve device is axially displaceable within the bore of the housing;

the junk guiding device is further configured to be provided in a pull state, in which the junk guiding device is pushed into the bore of the housing; and the guiding section is configured to be provided radially inside a housing of a setting tool in the run state, and where the setting tool, including the housing, is removed in the set state.

2. Junk catching device according to claim 1, where the junk guiding device is funnel-shaped in the set state.

3. Junk catching device according to claim 2, where the junk guiding device is funnel-shaped when unaffected by external forces.

4. Junk catching device according to any one of claims 1-3, where the junk guiding device is compressed to a cylindrical shape in the run state.

5. Junk catching device according to claim 1, where the junk guiding device comprises a bending area aligned with an upper end rim of the housing in the set state.

6. Junk catching device according to claim 1, where the sleeve device is fixed to the outer housing by means of a shear pin in the run state and/or the set state.

7. Junk catching device according to claim 1, where the sleeve device comprises an upper end rim.

8. Junk catching device according to claim 1, further comprising a slips device for anchoring to the well, where the slips device is configured to be provided between a run state and a set state.

9. Junk catching device according to claim 1, where the junk catching device is a device for catching junk falling or sinking down into the well.

10. Junk catching device according to claim 1, where, in the set state, the guiding section forms an upper part of a funnel, which has a circular opening.

* * * * *